US007851684B1

(12) United States Patent
Anderson et al.

(10) Patent No.: US 7,851,684 B1
(45) Date of Patent: Dec. 14, 2010

(54) ANCHOR BRACKET FOR MUSICAL INSTRUMENT STRINGS

(76) Inventors: Richard Anderson, 1218 N. 35th St., Renton, WA (US) 98056; Dean Wattles, 403-17th St. NW., Puyallup, WA (US) 98371

( * ) Notice: Subject to any disclaimer, the term of this patent is extended or adjusted under 35 U.S.C. 154(b) by 11 days.

(21) Appl. No.: 12/412,912

(22) Filed: Mar. 27, 2009

(51) Int. Cl.
*G10D 3/10* (2006.01)

(52) U.S. Cl. ..... 84/297 R

(58) Field of Classification Search ..... 84/297 R, 84/313
See application file for complete search history.

(56) References Cited

U.S. PATENT DOCUMENTS

| | | | | |
|---|---|---|---|---|
| 4,829,871 | A | 5/1989 | Manson | |
| 5,140,884 | A | 8/1992 | Bowden | |
| 5,260,504 | A | 11/1993 | Turner | |
| 7,566,823 | B1 * | 7/2009 | Niskanen | 84/313 |
| 2010/0106251 | A1 * | 4/2010 | Kast | 623/17.16 |

* cited by examiner

*Primary Examiner*—Jianchun Qin
(74) *Attorney, Agent, or Firm*—David L. Tingey

(57) ABSTRACT

A string anchor bracket useful is mounted to the underside of a bridge plate for anchoring a guitar string to a guitar bridge. The anchor bracket has plurality of notches on an anchor bracket plate spaced apart by depending members that depend from the plate at its forward edge forming slots that lead to corresponding notches.

19 Claims, 4 Drawing Sheets

ANCHOR BRACKET FOR MUSICAL INSTRUMENT STRINGS

BACKGROUND

1. Field of the Invention

This invention relates primarily to an anchor for securing a guitar string to a guitar bridge, and more specifically to a string anchor bracket for a guitar bridge.

2. Prior Art

Quality of sound from a guitar is enhanced through the construction of the guitar body, or guitar box, having an internal cavity in which acoustical waves resonate. Similar guitar strings mounted to different guitars will produce a different sound because of the construction of the guitar body. Different curvatures and woods employed in the body will produce different resonances. Primarily, acoustical vibrations are transferred from a vibrating string through the guitar sound hole. However, a significant contribution is obtained in the transfer of vibrations from the string directly to the guitar body through the mount of the string body end to the body through a guitar bridge that is permanently mounted rearward of the guitar sound hole in normal guitar construction. It is therefore important that the string engage the bridge in all methods of securing the strings to the bridge.

It is common for a guitar string to break after a period of use. Conventional replacement requires a tapered bridge pin to be removed and the string to be extracted from the bridge through a bridge pin hole that receives the bridge pin. A guitar string characteristically has a first end that is enlarged by the string at that end being wrapped around a ring. The string first end is then inserted into the bridge pin hole followed by the bridge pin with the string moved into a groove along the side of the bridge pin. The string is pulled tight and the pin is pressed into frictional engagement with the bridge top. The procedure might take about a couple of minutes.

Repeated removal and installation of the pin can damage the pin and more importantly will damage the bridge pin hole. When the guitar bridge hole is damaged, it must be repaired. Typically, this requires re-drilling the bridge pin hole to an enlarged size and replacing the pin with a larger pin. A better method would be to provide an anchor that does not require removal and reinstallation during string replacement and maintains the characteristic solid connection between the string and the guitar bridge to conduct string acoustical wave energy to the guitar bridge and hence to the guitar body.

SUMMARY OF THE INVENTION

An improved mounting of a set of guitar strings to a guitar is obtained with the string anchor bracket of the present invention. As stated, with repeated removal of a tapered pin from a bridge hole, the bridge hole suffers wear. As a result, the tapered pin begins to pop out of the bridge hole under pull from a tensioned string. The new string anchor of the present invention does not require a pin removal to change a string associated with the anchor bracket, which reduces wear to the guitar bridge and enables a faster change of a string. No part is removed as the string is easily released from the anchor simply by giving slack to the string and unhooking its enlarged end from the anchor bracket that has been installed in the guitar bridge and then pulling the unhooked string through a hole in the guitar bridge.

The anchor bracket is mounted within the guitar box on the bridge plate, usually by simply pulling the anchor bracket against the bridge plate where barbs on the anchor bracket are pulled into the bridge plate. Alternately or in addition, a thin adhesive or double-sided tape may be applied between the bridge plate and the anchor bracket, which is generally adequate along with the string tension to maintain the anchor bracket in place. With string tension pulling the anchor bracket against the bridge plate, the anchor bracket is firmly set on the bridge plate. The barbs are mostly to keep the anchor bracket from sliding. Also alternately or in addition, small holes may be provided in the anchor bracket through which small brads or screws may pass in securing the anchor bracket to the bridge plate. It is by design that the anchor bracket is quickly installed without modification to the guitar for facile installation and to maintain the integrity of the guitar in recognition that owners of guitars, especially expensive guitars, may be reluctant to drill holes or otherwise modify their guitars to install a string anchor.

DETAILED DESCRIPTION OF THE PREFERRED EMBODIMENTS

Figure 1:
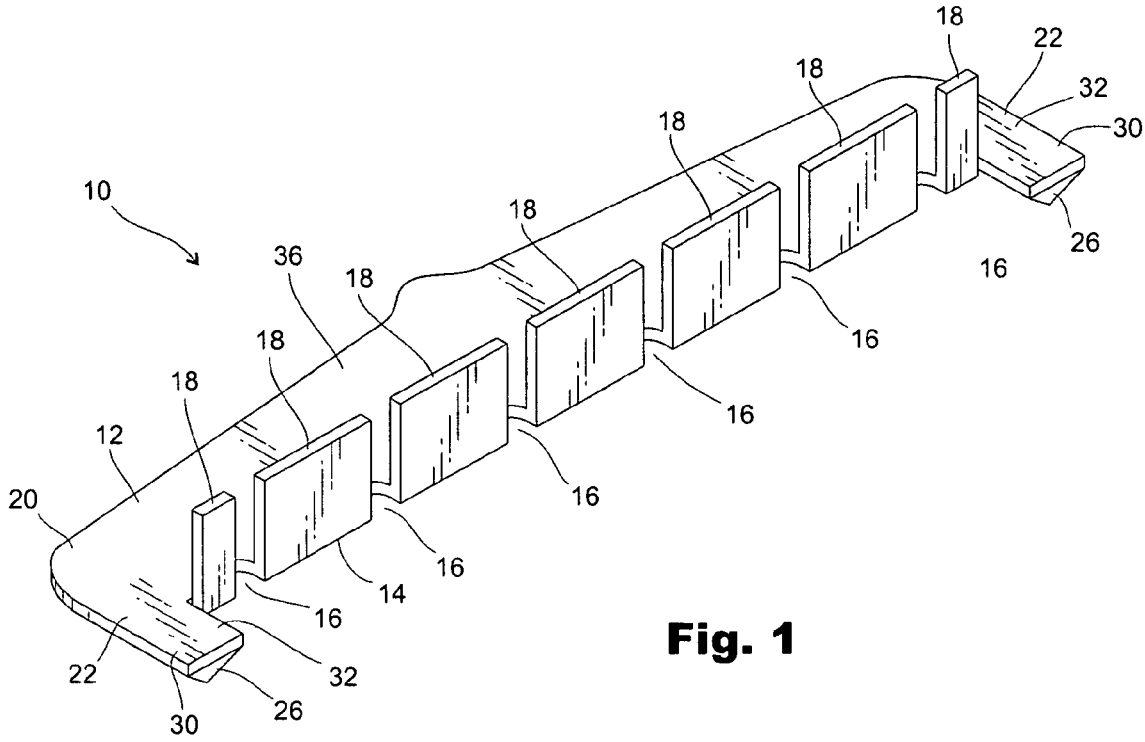
FIG. 1 is a front perspective view of the underside of the anchor bracket of the present invention, as would be viewed from within the guitar box when the anchor bracket is mounted to the bridge plate.
Figure 2:
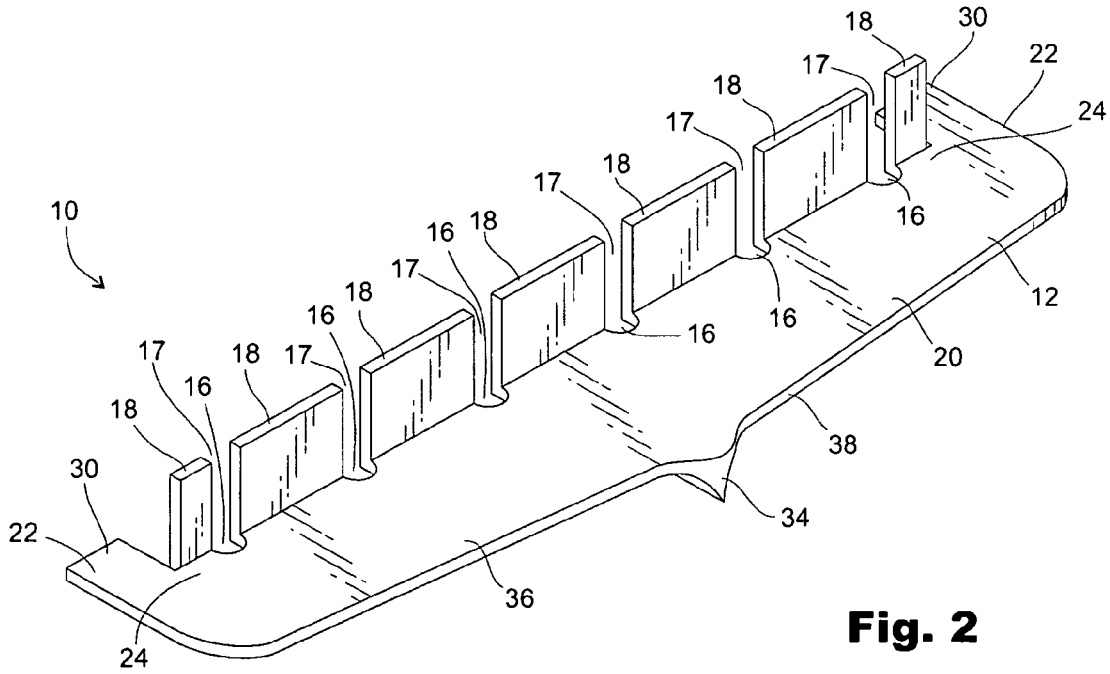
FIG. 2 is a back perspective view of the underside of the anchor bracket of FIG. 1.
Figure 3:
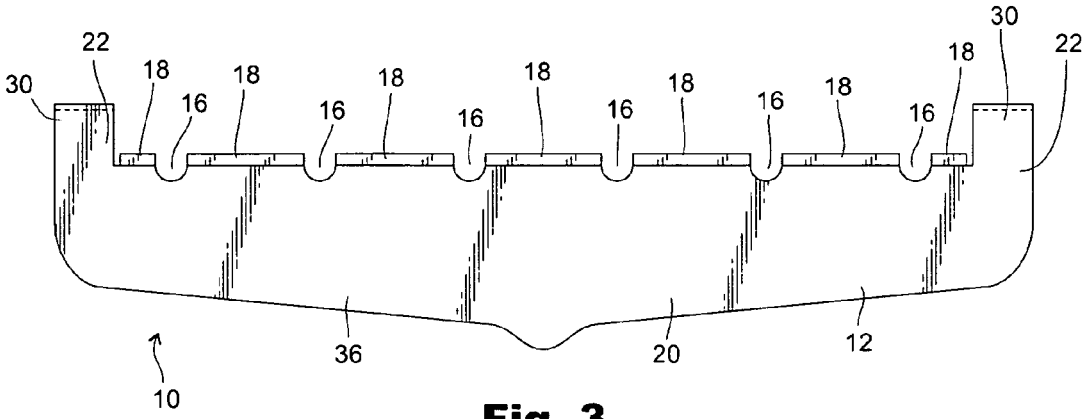
FIG. 3 is a bottom view of the anchor bracket of FIG. 1.
Figure 4:
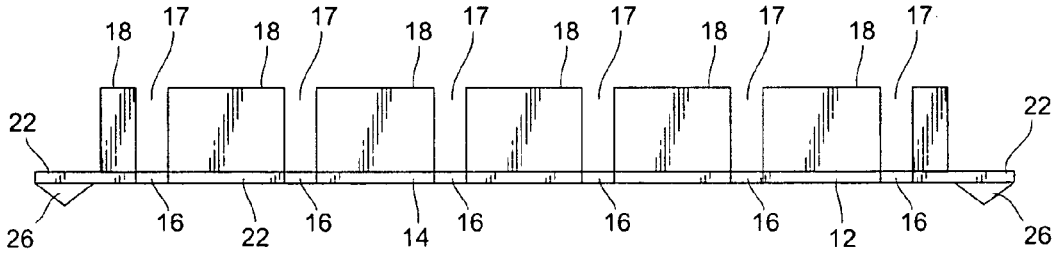
FIG. 4 front view of the anchor bracket of FIG. 1.
Figure 5:
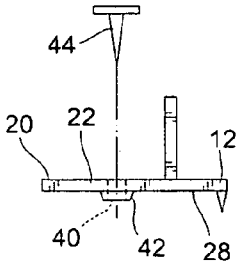
FIG. 5 is an end view of the anchor bracket of FIG. 1
Figure 6:
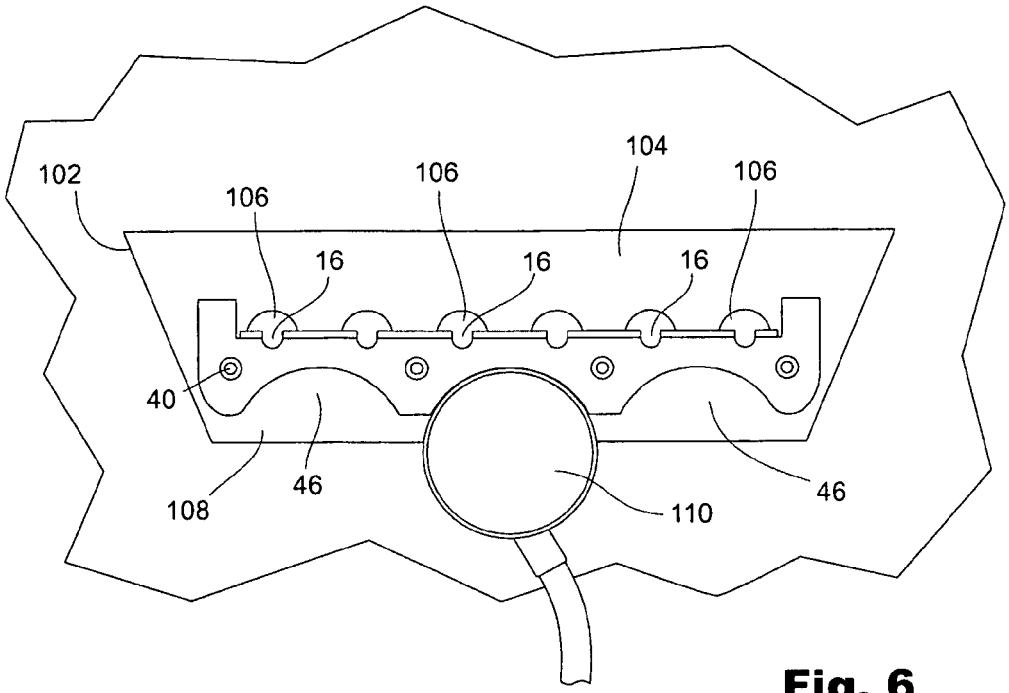
FIG. 6 is a perspective view of an alternate embodiment of the anchor bracket of FIG. 1, shown mounted within a guitar box to a bridge plate.

The string anchor bracket 10 of the present invention is for connecting a string 101 that has a string diameter with a string enlarged end 100 to a bridge 102 of a musical instrument, typically a guitar. For ease of description, all stringed musical instruments are deemed included in the within description. Further, attachment of a string or cable generally, that is, not in a musical instrument, is deemed included in the description of a string installed to a musical instrument by use of the described anchor bracket. Also, in describing the invention in terms of a bridge, and more specifically to a bridge plate as that part of the bridge within the guitar box, the bridge or bridge plate is deemed to mean any structure in which a hole is provided for receiving a string.

It is well known to have a musical instrument such as a guitar with an acoustical box 103 and a bridge plate 104 in the acoustical box. Guitar strings typically have a string diameter and an enlarged end 100 at a string end as a means of anchoring the string end to the guitar bridge plate 104.

Figure 7:
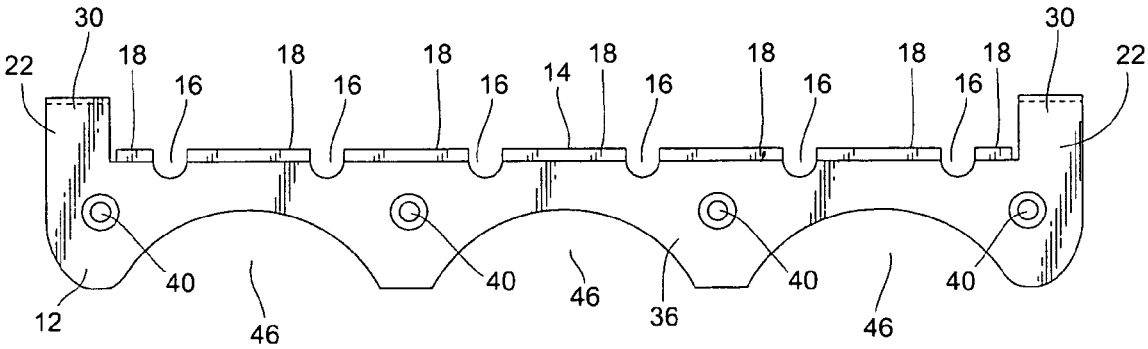
FIG. 7 is a bottom view of an alternate embodiment of the anchor bracket, showing three cut-outs for receiving electric guitar pickups.
Figure 8:
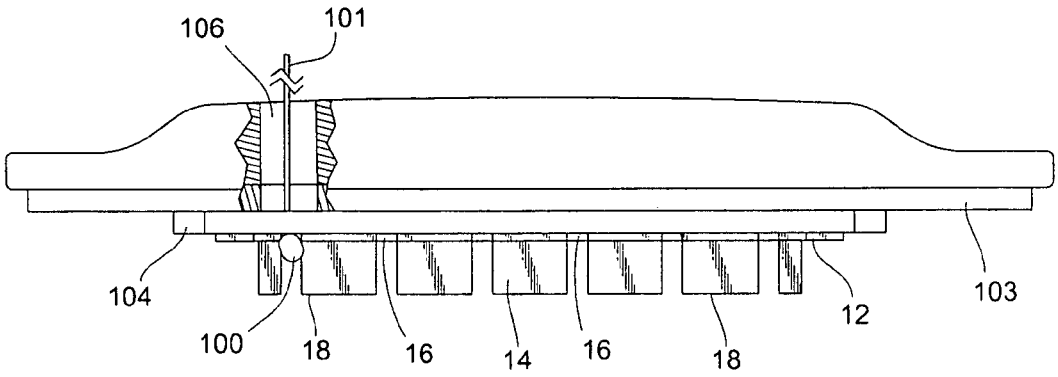
FIG. 8 is a front cut-away view of the anchor bracket of FIG. 1 shown mounted to a guitar bridge on a guitar acoustical box with a string enlarged end pulled against the bracket plate by a tensioned string.

The string anchor bracket 10 comprises an anchor bracket plate 12 adapted to be mounted in face to face contact with the guitar bridge plate 104 within the guitar box as shown in FIG. 7. Along the anchor bracket plate 12 at its forward edge 14 is a plurality of notches 16 uniformly spaced apart along the anchor bracket plate 12 in matching arrangement to the bridge plate 104 such that they align with bridge holes 106 when the anchor bracket plate 12 is mounted to the bridge plate 104. On each side of each notch 16 is a depending member 18 depending from the bottom 20 of the anchor bracket plate 12 at a plate forward edge 22 that extends between adjacent notches 16 resulting in slots 17 between adjacent members 18 that lead to corresponding notches 16.

In use, the anchor bracket 10 is mounted with its top 28 against a bridge plate bottom 108 with the notches 16 and its corresponding slot 17 aligned over corresponding bridge holes 106 into which the enlarged end 100 of a string is inserted. In securing a string to the anchor bracket, the string is adjusted to slip between a pair of adjacent members 18 and the string enlarged end 100 is adjusted to slip into the notch 16 between the pair of adjacent members 18. The notch 16 is sized in width to be smaller than the enlarged end 100 so when the string is tensioned the enlarged end 100 is pulled up against the anchor bracket plate 12 at the notch 16 without going through the notch 16. The notch 16 is sized in length so the enlarged end 100 is pulled against the anchor bracket plate 12 and not against the members 18 so string tension pulls the anchor bracket plate 12 directly against the bridge plate 104. This design that enlarged end 100 does not pull against the members 18 is to prevent torque from being imposed on the anchor bracket 10 which would tend to pull the anchor bracket off of the bridge plate 104, which would be the case if the string enlarged end 100 were pulling against the members 18.

Stability arms 22 extend from an anchor bracket plate rearward portion 36 at each plate end and forward of the depending members 18, the stability arms forming an anchor bracket plate forward portion 32, where the depending members divide anchor bracket plate forward and rearward portions 32, 36. Thus the string under tension pulls the anchor bracket plate 12, with stability arms also against the bridge, all around the bridge holes 106, dispersing the tension load about the bridge plate 104.

To keep the anchor bracket 10 from sliding, barbs 26 are placed conveniently on the top 28 of the anchor bracket 10. For illustrative purposes, barbs 26 are shown at the end 30 of each stability arm 22 at the forward portion 32 of the anchor bracket plate 12 and at least one barb 34 is located central on the rearward portion 36 of the anchor plate 12, typically at its rearward edge 38. Similarly, barb holes 40 may be punched in the rearward portion 36 of the anchor bracket plate 12, leaving barbs 42 around the punched barb hole 40 which is useful for attaching the anchor bracket plate 12 to the bridge plate 104. A brad 44 may also be inserted in the punched barb hole 40 to help attach the anchor bracket plate 12 to the guitar bridge 104.

In an alternate embodiment, the rearward portion 36 of the anchor bracket plate 12 has a plurality of recesses 46, typically three, for receiving electric guitar pickups 110. During installation, the anchor bracket plate 12 is adjusted into place with the guitar pickups 110 in the respective recesses. The anchor bracket 10 is then pulled up against the bridge plate 104.

Having described the invention, what is claimed is as follows:

1. A string anchor bracket for anchoring a plurality of strings on a stringed musical instrument, the musical instrument having a bridge with a bridge plate and a plurality of holes through the bridge including the bridge plate, and each of said strings having a string diameter and an enlarged end sized to pass through one of said bridge holes in anchoring said string to said musical instrument bridge under string tension, the improvement comprising an anchor bracket plate with a bottom and with a top adapted to mount to the bridge plate and a plurality of notches spaced apart on an anchor bracket plate forward edge such that the notches align with holes in a guitar bridge when the anchor bracket plate is mounted to the bridge plate, and a depending member on each side of each notch depending from the bottom of the anchor bracket plate at a plate forward edge resulting in a slot between each pair of adjacent depending members that leads to the notches, wherein the anchor bracket is thus adapted to mount to the bridge with the notches aligned with corresponding bridge holes such that for each string, the string can pass through into a said bridge hole and through the slot and the string enlarged end can be manipulated below the notch such that when the string is pulled upward through the bridge hole, the string enlarged end is pulled against the anchor bracket plate, further comprising a stability arm extending from an anchor bracket plate rearward portion at each plate end and extending forward of the depending members, the stability arms forming an anchor bracket plate forward portion, where the depending members divide anchor bracket plate forward and rearward portions.

2. The string anchor bracket of claim 1 further comprising at least one barb extending from the top of the anchor bracket plate adapted to engage said bridge plate.

3. The string anchor bracket of claim 1 further comprising at least one barb extending from the top of the anchor bracket plate adapted to engage said bridge plate.

4. The string anchor bracket of claim 3 further comprising at least one barb extending from at least one of said stability arms adapted to engage said bridge plate.

5. The string anchor bracket of claim 3 wherein said at least one barb compromises a hole punched through the anchor bracket plate leaving said barb extending from around said hole.

6. The string anchor bracket of claim 1 wherein said anchor bracket plate has at least one hole therethrough and further comprising a brad adapted to pass through said at least one hole into engagement with said bridge plate.

7. The string anchor bracket of claim 1 wherein said slots are larger in width than a said string and smaller in width than the string enlarged end.

8. The string anchor bracket of claim 1 wherein the depending members extend between adjacent notches.

9. The string anchor bracket of claim 1 wherein the anchor bracket plate includes at least one recess adapted to receive an electric guitar pickup therein.

10. A string anchor bracket for anchoring a plurality of strings on a stringed musical instrument, the musical instrument having a bridge with a bridge plate and a plurality of holes through the bridge including the bridge plate, and each of said strings having a string diameter and an enlarged end sized to pass through one of said bridge holes in anchoring said string to said musical instrument bridge under string tension, the improvement comprising an anchor bracket plate with a bottom and with a top adapted to mount to the bridge plate and a plurality of notches spaced apart on an anchor bracket plate forward edge such that the notches align with holes in a guitar bridge when the anchor bracket plate is mounted to the bridge plate, a depending member on each side of each notch depending from the bottom of the anchor bracket plate at a plate forward edge and extending between adjacent notches resulting in a slot between each pair of adjacent depending members that leads to the notches, wherein said slots are larger in width than a said string and smaller in width than the string enlarged end, and wherein the anchor bracket is thus adapted to mount to the bridge with the notches aligned with corresponding bridge holes such that for each string, the string can pass through into a said bridge hole and through the slot and the string enlarged end can be manipulated below the notch such that when the string is pulled upward through the bridge hole, the string enlarged end is pulled against the anchor bracket plate, a stability arm extending from an anchor bracket plate rearward portion at each plate end and extending forward of the depending members, the stability arms forming an anchor bracket plate forward portion, where the depending members divide anchor bracket plate forward and rearward portions.

11. The string anchor bracket of claim 10 further comprising at least one barb extending from the top of the anchor bracket plate adapted to engage said bridge plate.

12. The string anchor bracket of claim 11 wherein said at least one barb compromises a hole punched through the anchor bracket plate leaving said barb extending from around said hole.

13. The string anchor bracket of claim 10 further comprising at least one barb extending from at least one of said stability arms adapted to engage said bridge plate.

14. The string anchor bracket of claim 10 wherein the anchor bracket plate includes at least one recess adapted to receive an electric guitar pickup therein.

15. A musical instrument with a plurality of strings adapted to vibrate to produce musical tones, the musical instrument having a bridge with a bridge plate and a plurality of holes through the bridge including the bridge plate, said strings each having a string diameter and an enlarged end sized to pass through one of said bridge holes and each being adapted to anchor said string end to mount to the bridge and anchor said plurality of strings on the musical instrument, the improvement comprising an anchor bracket plate with a bottom and with a top adapted to mount to the bridge plate and a plurality of notches spaced apart on an anchor bracket plate forward edge such that the notches align with the plurality of holes in the guitar bridge, a depending member on each side of each notch depending from the bottom of the anchor bracket plate at a plate forward edge and extending between adjacent notches resulting in a slot between each pair of adjacent depending members that leads to the notches, wherein said slots are larger in width than a said string diameter and smaller in width than the string enlarged end, wherein the anchor bracket is mounted on the bridge plate with each of said notches with its corresponding slot is over a corresponding bridge hole such that for each string, the string can pass through into a said bridge hole and through the slot and the string enlarged end can be manipulated below the notch such that when the string is pulled upward through the bridge hole, the string enlarged end is pulled against the anchor bracket plate, a stability arm extending from an anchor bracket plate rearward portion at each plate end and extending forward of the depending members, the stability arms forming an anchor bracket plate forward portion, where the depending members divide anchor bracket plate forward and rearward portions.

16. The string anchor bracket of claim 15 further comprising at least one barb extending from the top of the anchor bracket plate adapted to engage said bridge plate.

17. The string anchor bracket of claim 16 further comprising at least one barb extending from at least one of said stability arms adapted to engage said bridge plate.

18. The string anchor bracket of claim 17 wherein said at least one barb compromises a hole punched through the anchor bracket plate leaving said barb extending from around said hole.

19. The string anchor bracket of claim 15 wherein the anchor bracket plate includes at least one recess adapted to receive an electric guitar pickup therein.

* * * * *